US006044566A

United States Patent [19]

Ries et al.

[11] Patent Number: 6,044,566

[45] Date of Patent: Apr. 4, 2000

[54] PLASTIC KNIFE

[76] Inventors: Wendy Ries; George Ries, both of Box 433, Humboldt, Saskatchewan, Canada, S0K 2A0

[21] Appl. No.: 08/799,682

[22] Filed: Feb. 13, 1997

[51] Int. Cl.[7] ..... B26B 9/02

[52] U.S. Cl. ..... 30/345; 30/355; 30/357

[58] Field of Search ..... 30/142, 147, 148, 30/149, 165, 346, 348, 355, 356, 357, 115, 345, 350; D7/649, 650; D8/20

[56] References Cited

U.S. PATENT DOCUMENTS

| | | | |
|---|---|---|---|
| D. 24,386 | 6/1895 | Christy | 30/355 X |
| D. 125,774 | 4/1941 | Madan | D7/650 |
| D. 237,450 | 11/1975 | Montesi | 30/115 X |
| 556,615 | 3/1896 | Campbell | 30/355 |
| 693,524 | 2/1902 | Korn | 30/348 X |
| 2,279,833 | 4/1942 | Madan | 30/355 X |
| 2,555,735 | 5/1951 | Estabrooks | 30/357 X |
| 2,566,112 | 8/1951 | Barnard | 30/357 |
| 2,685,734 | 8/1954 | Klein | 30/355 X |
| 3,035,344 | 5/1962 | Brown | 30/115 |
| 3,203,295 | 8/1965 | Sauer | 30/355 X |
| 4,119,004 | 10/1978 | Ludwig | 30/355 X |

FOREIGN PATENT DOCUMENTS

| | | | |
|---|---|---|---|
| 803826 | 4/1951 | Germany | 30/355 |
| 886832 | 1/1962 | United Kingdom | 30/355 |
| 909277 | 10/1962 | United Kingdom | 30/357 |
| WO 93/08960 | 5/1993 | WIPO | 30/346 |

*Primary Examiner*—Clark F. Dexter
*Attorney, Agent, or Firm*—M. E. Thrift; A. D. Battison

[57] ABSTRACT

Knives molded from a plastics material for cutting lettuce and for cutting baked goods in a non-stick pan respectively are described. The blade portions of the knives include a cutting edge comprised of arcuate, convex segments. The thickness of the blade increases from the cutting edge in discrete steps, resulting in a stronger blade that remains sharp longer. Being molded from a plastics material, the knives will not promote the oxidation of cut lettuce nor scratch or damage the surface of a non-stick pan respectively.

4 Claims, 4 Drawing Sheets

PLASTIC KNIFE

FIELD OF THE INVENTION

The present invention relates generally to kitchen tools and, more specifically, to plastic kitchen knives.

BACKGROUND OF THE INVENTION

Due to a lack of alternatives, metal knives are often used for tasks for which they are poorly suited. One example is using a metal knife to cut lettuce. The metal knife promotes oxidation of the cut lettuce, turning the trimmed portion of the lettuce from green to an unappetizing dark brown. Another example is using a metal knife to cut baked goods in a non-stick pan. In this instance, great care must be taken to avoid scratching or otherwise damaging the non-stick surface of the pan with the blade of the metal knife. In both cases, an obvious solution would be to use plastic knives. However, typical plastic knives lack the strength and durability to perform tasks such as these repeatedly. Furthermore, the blades of plastic knives tend to become dull relatively quickly, thereby necessitating frequent replacement. As a solution, the present invention describes plastic knives of increased strength and durability designed specifically for performing the above-described tasks.

SUMMARY OF THE INVENTION

According to a first aspect of the invention, there is provided a knife for cutting lettuce comprising a blade of a plastics material having an edge portion with a cutting edge comprising a series of curved edge segments along the cutting edge, the edge portion having a thickness that increases in discrete steps with increasing distance from the cutting edge.

The edge segments may be arcuate convex segments and the adjacent edge segments may intersect at an angle. The cutting surface of the blade is maximized by arranging the edge segments in this manner.

Preferably, the knife includes a plastics material handle integral with the blade.

Being of a plastics material, the above-described knife will not promote the oxidation of cut lettuce. Furthermore, the stepped segments that comprise the cutting edge of the blade result in a blade that remains sharp for a longer period of time and form a wider blade. This in turn increases the strength and durability of the blade.

According to a second aspect of the invention, there is provided a method of cutting lettuce comprising:

providing a head of lettuce;

providing a knife for cutting lettuce comprising a blade of a plastics material having an edge portion with a cutting edge comprising a series of curved edge segments along the cutting edge, the edge portion having a thickness that increases in discrete steps with increasing distance from the cutting edge; and preventing oxidation of the lettuce after cutting by cutting the head of lettuce with the cutting edge of the knife.

Since the knife is of a plastics material, the above-described method will inhibit the oxidation of cut lettuce.

According to a third aspect of the invention, there is provided a knife for cutting baked goods comprising a blade of a plastics material having an edge portion with a cutting edge comprising a series of curved edge segments along the cutting edge, the edge portion having a thickness that increases in discrete steps with increasing distance from the cutting edge, wherein the cutting edge has a substantially straight tip portion for contacting a flat surface of a pan, said tip portion being oriented at an oblique angle to a tangent to the curved edge segments of the cutting edge.

The edge segments may be arcuate convex segments and the adjacent edge segments may intersect at an angle. The cutting surface of the blade is maximized by arranging the edge segments in this manner.

Preferably, the knife includes a plastics material handle integral with the blade. Being of a plastics material, the above-described knife will not scratch or otherwise damage the surface of a non-stick pan. Furthermore, the angled tip portion of the blade allows the knife to cut to the edge of the pan. The stepped segments that comprise the cutting edge of the blade result in a blade that remains sharp for a longer period of time and form a wider blade. This in turn increases the strength and durability of the blade.

According to a fourth aspect of the invention, there is provided a method of cutting baked goods in a non-stick pan comprising:

providing baked goods in a non-stick pan, said pan having a base and at least one side;

providing a knife for cutting baked goods comprising a blade of a plastics material having an edge portion with a cutting edge comprising a series of curved edge segments along the cutting edge, the cutting edge having a thickness that increases in discrete steps with increasing distance from the cutting edge, wherein the edge portion has a substantially straight tip portion for contacting a flat surface of a pan, said tip portion being oriented at an oblique angle to a tangent to the curved edge segments of the cutting edge;

inserting the knife into the baked goods such that the tip engages the base of the non-stick pan; and cutting the baked goods with the cutting edge of the knife.

Since the knife is of a plastics material, the above-described method will not scratch or otherwise damage the surface of a non-stick pan.

DETAILED DESCRIPTION

Figure 1:
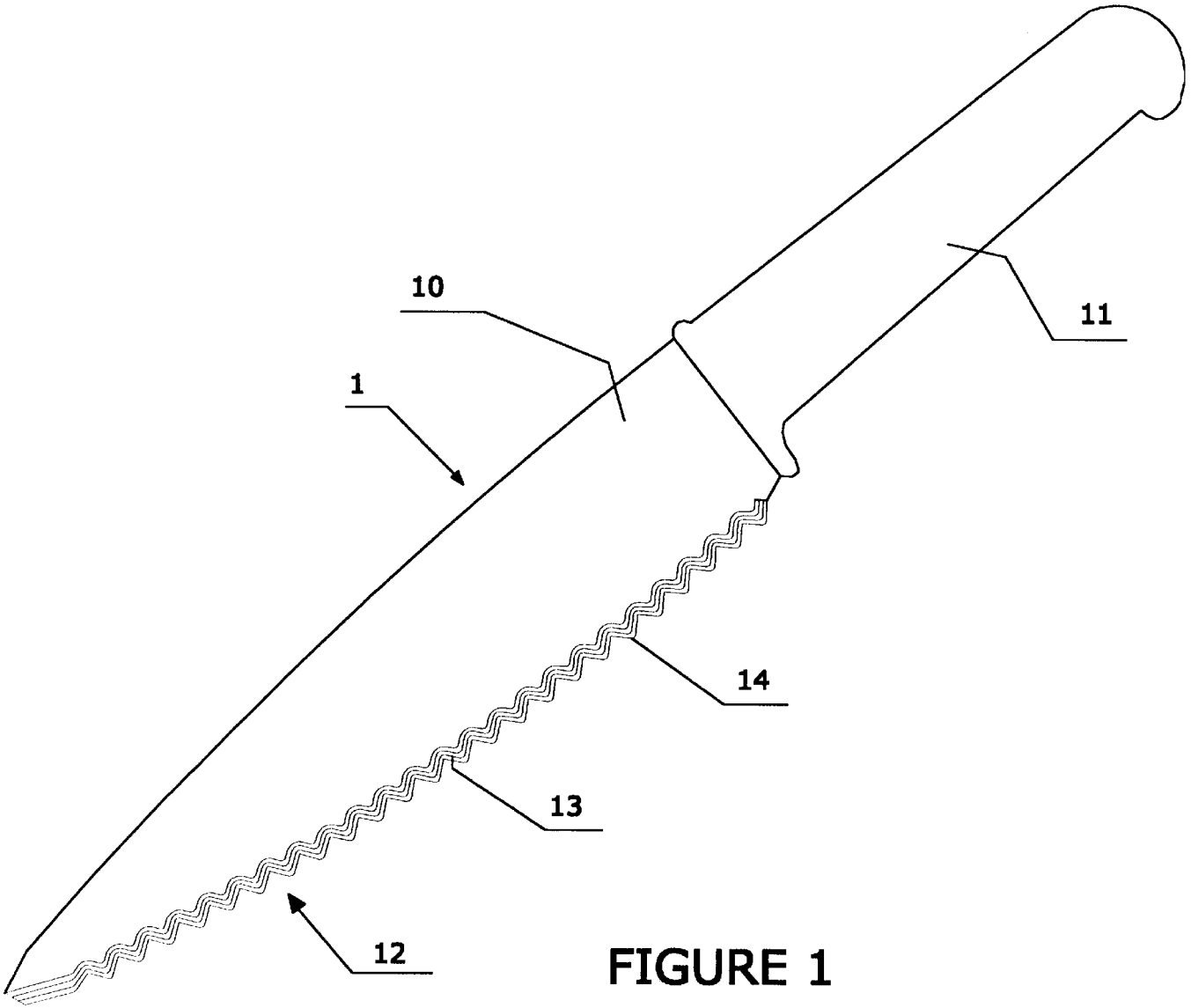
FIG. 1 is a side view of the lettuce knife.
Figure 2:
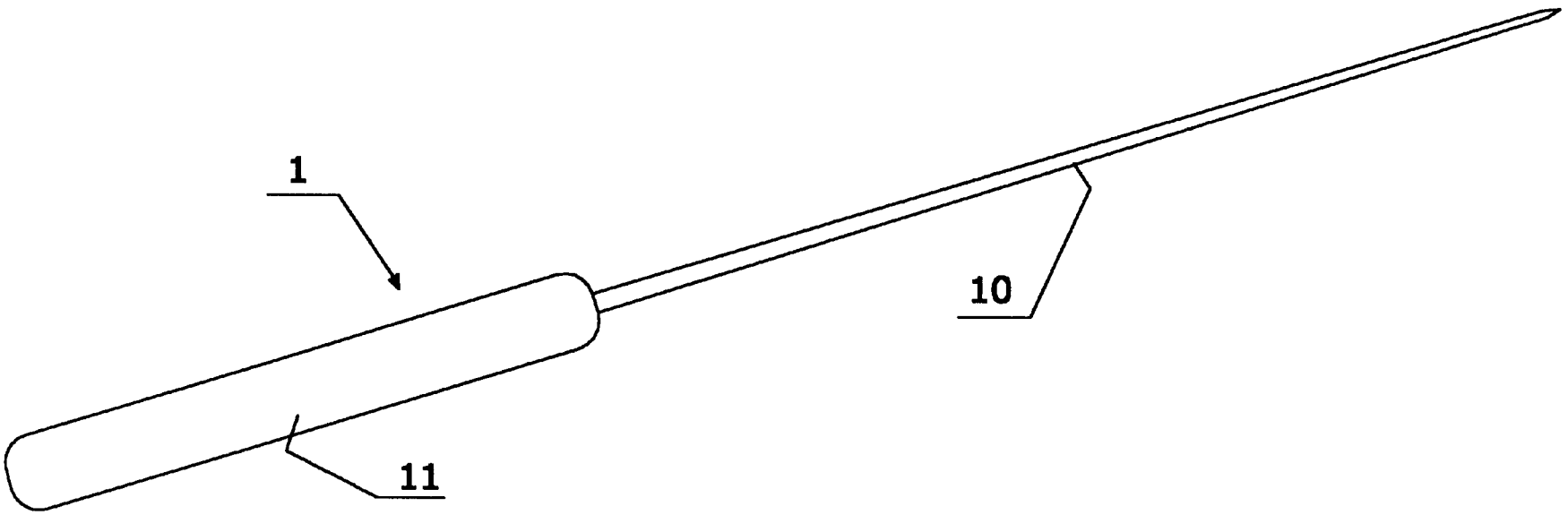
FIG. 2 is a top plan view of the lettuce knife.

In one embodiment, the lettuce knife 1 is molded from a plastics material and comprises a blade 10 integral with a handle 11, as shown in FIGS. 1–2. The handle 11 is generally rectangular in shape and of a thickness that is greater than the thickness of the blade 10. The blade 10 extends longitudinally from the handle 11. The blade 10 further comprises a cutting edge 12 that extends from the blade 10 in a downward direction. The cutting edge 12 comprises a series of curved segments 13. Specifically, the curved segments 13 are arcuate and convex in shape and intersect one another at an angle. This arrangement increases the length of the cutting edge 12 of the lettuce knife 1. The thickness of the blade 10 increases in multiple discrete steps 14 extending upward from the cutting edge 12. The discrete steps 14 form a high-layered serration which strengthens the blade 10 by increasing the thickness of the blade 10 and holds the sharpness of the blade 10 longer than the blades of ordinary plastic knives.

Figure 5:
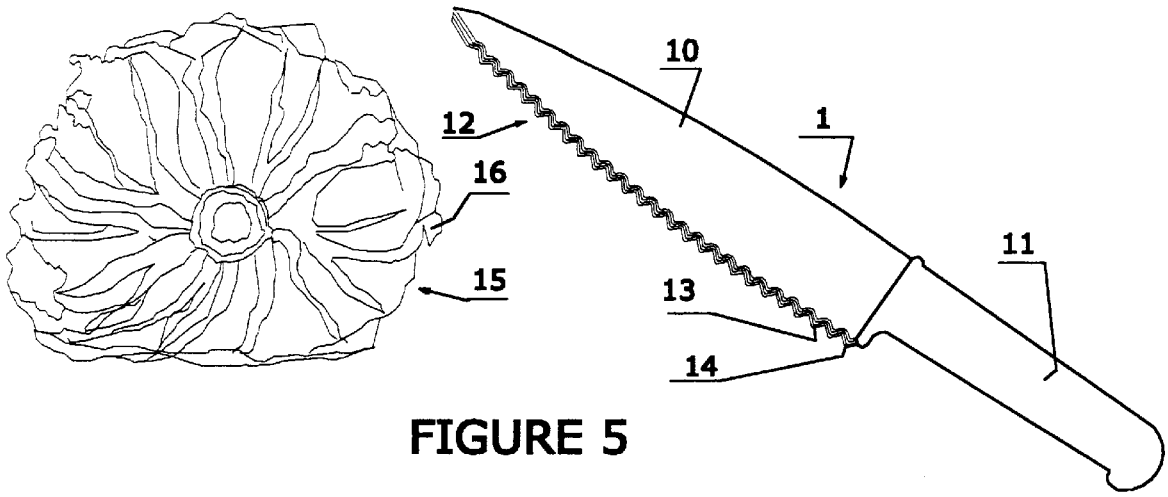
FIG. 5 is a schematic diagram of the lettuce knife in operation.
Figure 6:
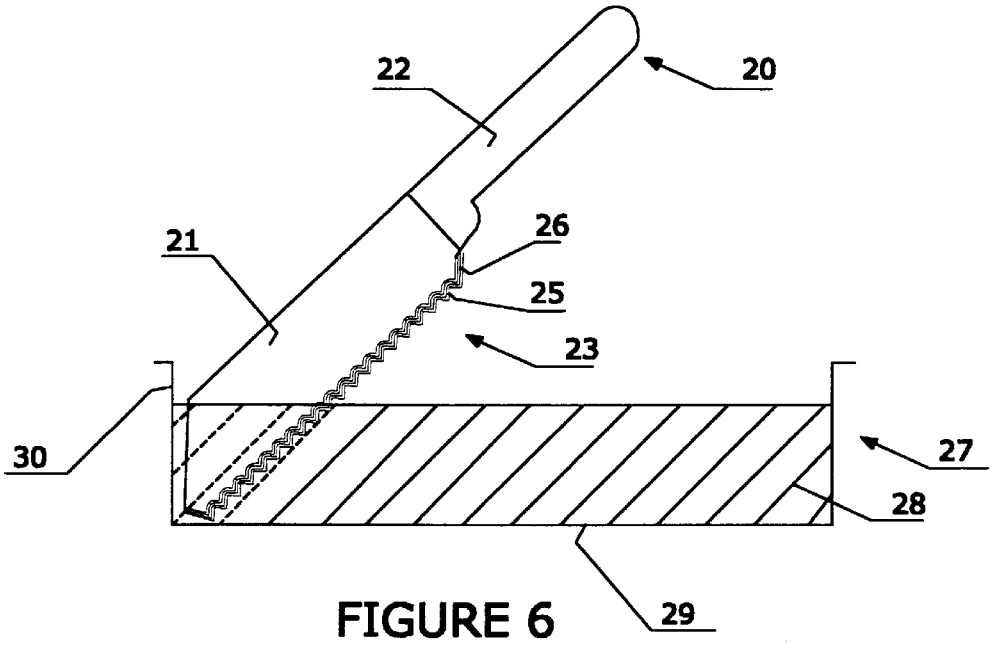
FIG. 6 is a schematic diagram of the baking knife in operation.

In operation, the user grips the handle 11 of the lettuce knife 1 in one hand and the lettuce 15 to be cut in the other hand as illustrated in FIG. 5. The user then brings the cutting edge 12 of the blade 10 into direct contact with the outer layer 16 of the lettuce 15 and begins a cutting motion with the lettuce knife 1. The curved segments 13 of the cutting edge 12 engage the outer layer 16 of the lettuce 15, thereby cutting the lettuce 15. Because the lettuce knife 1 is made of a plastics material, oxidation of the cut portion of the lettuce is not promoted. As a consequence, the trimmed portion of the lettuce remains green and appetizing.

Figure 3:
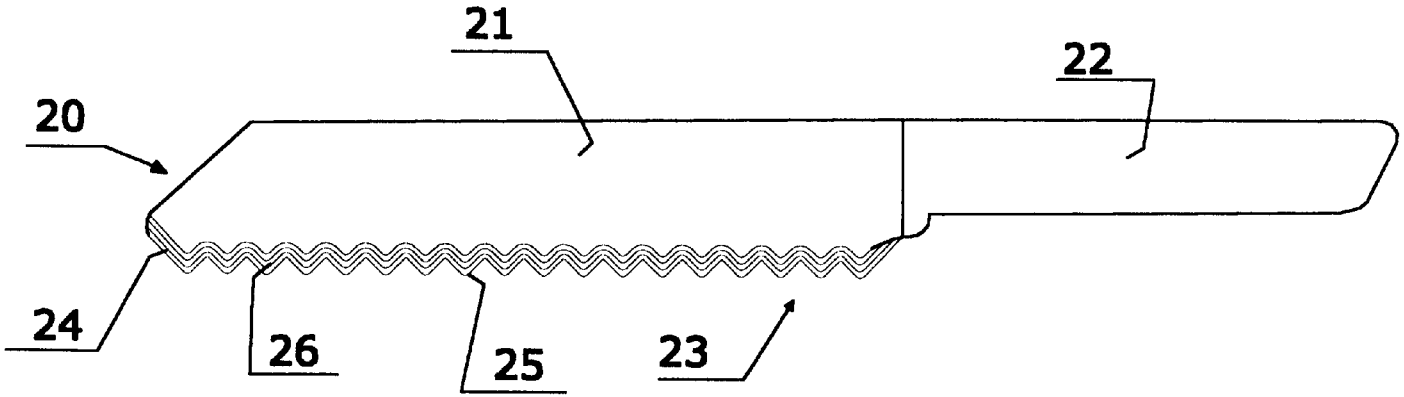
FIG. 3 is a side view of the baking knife.
Figure 4:
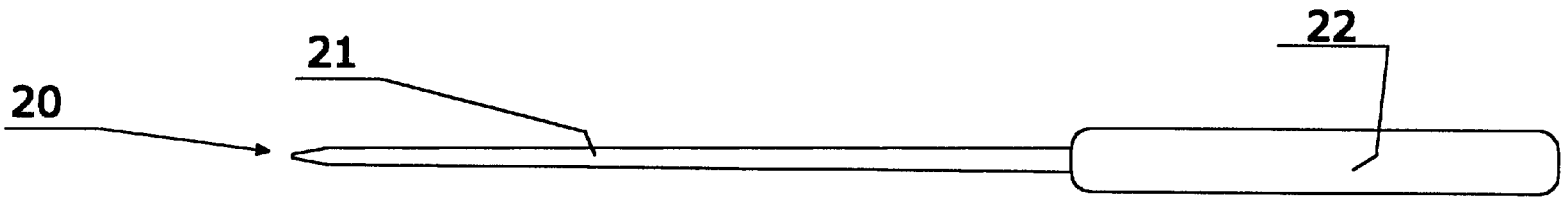
FIG. 4 is a top plan view of the baking knife.

In another embodiment illustrated in FIGS. 3–4, a baking knife 20 is molded from a plastics material and comprises a blade 21 integral with a handle 22, as shown in FIGS. 3–4. The handle 22 is generally rectangular in shape and of a thickness that is greater than the thickness of the blade 21. The blade 21 extends longitudinally from the handle 22. The blade 21 comprises a cutting edge 23 and a tip portion 24. The cutting edge 23 extends from the blade 21 in a downward direction. The cutting edge 23 comprises a series of curved segments 25. Specifically, the curved segments 25 are arcuate and convex in shape and intersect one another at an angle. This arrangement increases the length of the cutting edge 23. The tip portion 24 comprises a straight edge oriented at an oblique angle to the tangent to the curved segments 25. In one embodiment, the tip portion 24 is at a 45° angle to the tangent to the curved segments 25. The angled tip portion 24 engages the base of the non-stick pan during the cutting process as described below. The thickness of the blade 21 increases in multiple discrete steps 26, extending upward from the cutting edge 23. The discrete steps 26 form a high-layered serration which strengthens the blade 21 by increasing the thickness of the blade 21 and holds the sharpness of the blade 21 for longer than the blades of ordinary plastic knives.

In operation, a non-stick pan 27 having a base 29 and sides 30 and containing baked goods 28 is provided. The user grips the handle 22 of the baking knife 20 and inserts the blade 21 of the baking knife 20 so that the tip portion 24 enters the baked goods 28 first. The insertion process continues until the tip portion 24 contacts the base 29 of the non-stick pan 27. Once this is done, the baking knife 20 is pulled through the baked goods 28. During this process, the curved segments 25 of the cutting edge 23 engage the baked goods 28, thereby cutting the baked goods 28. The angular nature of the tip portion 24 means that the baking knife 20 can be inserted into the baked goods 28 at a position that is immediately adjacent to any side 30 of the non-stick pan 27. Thus, it is possible to cut the baked goods 28 right to the edge of the non-stick pan 27. Furthermore, as the baking knife 20 is made of a plastics material, it will not scratch or damage the surface of the non-stick pan during the cutting process.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A knife for cutting lettuce comprising a blade of a plastics material having an edge portion with a planer cutting edge, said cutting edge extending along a length of the blade and comprising a series of curved arcuate convex edge segments arranged such that adjacent edge segments intersect at an angle, the edge portion having a thickness that increases in multiple discrete steps with increasing distance from the cutting edge, wherein each of the multiple discrete steps extends along the cutting edge on opposite sides of the blade, wherein each of the steps includes a series of curved arcuate convex step segments, and wherein each of the step segments substantially corresponds in location alone the length of the blade to a respective one of the curved arcuate edge segments of the cutting edge, said multiple discrete steps arranged to form a high layer serration.

2. The knife according to claim 1 including a plastics material handle integral with the blade.

3. A knife for cutting baked goods comprising a blade of a plastics material having an edge portion with a planer cutting edge, said cutting edge extending along a length of the blade and comprising a series of curved arcuate convex edge segments arranged such that adjacent edge segments intersect at an angle, the edge portion having a thickness that increases in multiple discrete steps with increasing distance from the cutting edge, wherein each of the multiple discrete steps extends along the cutting edge on opposite sides of the blade, wherein each of the steps includes a series of curved arcuate convex step segments, and wherein each of the step segments substantially corresponds in location along the length of the blade to a respective one of the curved arcuate edge segments of the cutting edge, said multiple discrete steps arranged to form a high layer serration, said cutting edge having a substantially straight tip portion for contacting a flat surface of a pan, said tip portion being located at a front end of the blade and extending at an oblique angle to a tangent of the curved edge segments of the cutting edge.

4. The knife according to claim 3 including a plastics material handle integral with the blade.

* * * * *